US005593027A

United States Patent [19]

Sutherland

[11] Patent Number: 5,593,027

[45] Date of Patent: Jan. 14, 1997

[54] CARRIER WITH PREFORMED END PANELS

[75] Inventor: Robert L. Sutherland, Kennesaw, Ga.

[73] Assignee: Riverwood International Corporation, Atlanta, Ga.

[21] Appl. No.: 541,355

[22] Filed: Oct. 10, 1995

[51] Int. Cl.[6] ..... B65D 71/36

[52] U.S. Cl. ..... 206/170; 206/198; 206/428

[58] Field of Search ..... 206/140, 141, 206/174–192, 198, 427, 428, 434, 170

[56] References Cited

U.S. PATENT DOCUMENTS

| | | | |
|---|---|---|---|
| 2,705,556 | 4/1955 | Ringler | 206/427 |
| 4,034,852 | 7/1977 | Forrer | 206/141 |
| 4,201,295 | 5/1980 | Morcom | 206/174 |
| 4,396,116 | 8/1983 | Stone | 206/175 |
| 4,588,077 | 5/1986 | Champlin et al. | 206/185 |
| 4,817,797 | 4/1989 | Hamelin | 206/427 |
| 5,381,891 | 1/1995 | Harris | 206/428 |

FOREIGN PATENT DOCUMENTS

| | | | |
|---|---|---|---|
| 85/02385 | 6/1985 | WIPO | 206/434 |

*Primary Examiner*—Jimmy G. Foster

[57] ABSTRACT

An article carrier which includes a handle connected to and extending between opposite side panels. End panels of the carrier are divided into halves by vertical fold lines, and the handle includes a fold line which lies in the same plane as the end panel fold lines. This construction allows a collapsed carrier to be squared up from a folded condition. The carrier may take the form of a wrap-around carrier having a top panel or an open-top basket-style carrier.

14 Claims, 5 Drawing Sheets

CARRIER WITH PREFORMED END PANELS

FIELD OF THE INVENTION

This invention relates to article carriers of the wrap-around type. More particularly, it relates to a wrap-around carrier which has preformed end panels.

BACKGROUND OF THE INVENTION

Articles such as beverage bottles and cans are commonly packaged in three main types of carriers. One is a fully enclosed carrier which is normally formed by introducing articles through one or two open ends of an erected carton, then closing and gluing the end panels. Although this type of carrier has advantages, such as providing a maximum amount of carrier surface for receiving printing or other indicia and protecting against the articles accidentally falling out, it is relatively expensive and requires specialized machinery to produce.

Another type is the basket-style carrier, which is open at the top and includes a central handle separating the carrier into two halves. It is normally introduced to a packaging machine in the form of a collapsed carrier, after which it is opened or erected and loaded with the articles to be packaged. Depending on the design, loading is done either by inserting the articles from the top onto a preformed bottom panel or by lowering the erected carrier over the articles and then forming the bottom panel. A basket carrier is less expensive and allows at least the upper portions of the articles to be viewed. The open top also facilitates removal of the articles by a consumer.

The third type is a wrap-around carrier, which is formed by folding a blank around a group of articles and fastening the ends of the blank together. Typically, the ends are secured at the bottom of the carrier. A wrap-around carrier is more economical, but has several drawbacks. The ends of the package are normally open. Even though the wrap may be drawn so tightly around the articles that there is little risk of the articles falling out of the package, the open ends contribute to confusion at retail outlets because the price scanners that read the pricing code on the carrier may at times read the pricing code on an individual article, resulting in the wrong price being charged. Wrap-around carriers have been designed with partial end panels which cover the pricing code on the end articles in the package, but they are usually formed from blanks which include gusset panels for connecting the partial end panels to one or more of the other carrier panels. The folding of the gusset panels in addition to the folding of the blank complicates the design of the packaging machinery and tends to slow the packaging operation.

It would be highly desirable to be able to employ an improved wrap-around carrier having the economical advantages of a conventional wrap-around carrier and, in addition, incorporating end panels without using gusset panels. Preferably, the design would allow a packaging machine adapted to handle basket-style carriers to also handle wrap-around carriers of the new design, thus reducing the number of packaging machines necessary to produce different styles of packages.

A primary object of the invention, therefore, is to provide a carrier which accomplishes these goals.

BRIEF SUMMARY OF THE INVENTION

The invention may be incorporated in carriers of the wrap-around type or in basket-style carriers. In either case the carrier comprises a pair of substantially parallel side panels, a pair of end panels connected to the side panels, a bottom panel connected to the side panels and a handle connected to and extending between the side panels. The handle and each of the end panels include a fold line lying in a plane which is substantially parallel to the side panels. This construction allows the carrier to be formed from a blank which has been folded and glued to a collapsed state in which the fold line of the handle and the fold line of the end panels lie in substantially the same plane. The bottom panel of the carrier preferably is formed from two connected bottom panel flaps, each flap being connected to one of the side panels.

For a wrap-around type of carrier a top panel is connected to the side panels on either side of the handle, and includes a fold line lying in the same plane as the fold lines of the handle and the end panels. The handle in such an arrangement preferably is a strap defined by spaced slits in the top panel.

For a basket-style carrier the handle is of two-ply construction formed from opposite handle panels connected by a fold line extending transversely of the side panels. Each handle panel is connected by a tuck panel arrangement to a handle support panel, which in turn is connected by a fold line to an associated side panel.

Either type of carrier is readily formed from a blank which has been folded into collapsed carrier condition. In such condition the end panels will have been formed but the bottom panel is formed from bottom panel flaps after loading the articles to be packaged into the opened or erected carrier. The carrier is easily formed from a blank which has been produced from a minimum amount of stock. Further, either type of carrier may be formed on the same packaging machine, which reduces machinery costs by a considerable amount.

These and other features and aspects of the invention, as well as other benefits, will readily be ascertained from the detailed description of the preferred embodiments described below.

DETAILED DESCRIPTION OF THE PREFERRED EMBODIMENTS

Figure 1:
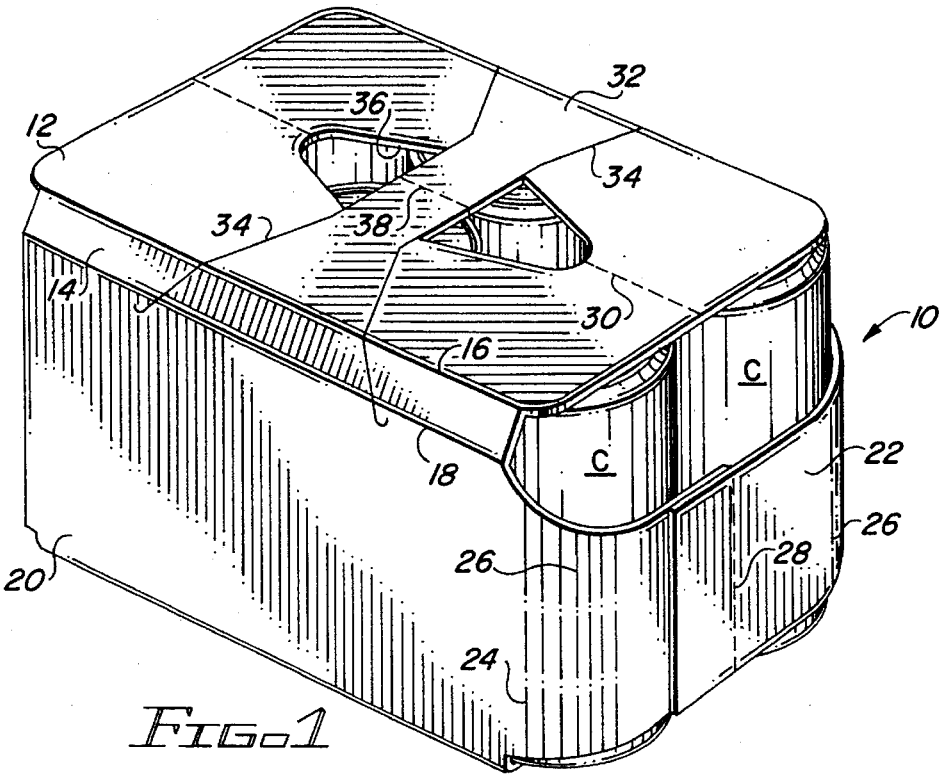
FIG. 1 is a pictorial view of a beverage can carrier incorporating the invention.

Referring to FIG. 1, a carrier 10 containing six beverage cans C is comprised of a top panel 12 connected to short bevel panels 14 by fold lines 16. Fold lines 18 connect the bevel panels to side panels 20 which are connected to a bottom panel, not visible in this view. End panels 22 are connected to the side panels by score lines 24 and include a series of spaced parallel score lines 26 which enable the end panels to curve smoothly about the rounded circumference of the cans at the corners of the carrier.

From the structure described, the carrier would seem to be a conventional wrap-around carrier which has been provided with suitable gusset panels or tuck flaps to enable formation of the end panels. The end panels would have been formed by folding in separate end panel flaps connected to the side panels at the time the carrier blank was wrapped about the beverage cans. In the carrier of FIG. 1, however, the end panels have been preformed and include a central fold line 28. The top panel 12 also includes a central fold line 30 lying in the same plane as the fold line 28.

The carrier also includes a handle strap 32 formed by spaced transverse slits 34 which extend down through the bevel panels 14 and terminate in the upper portion of the side panels 20. Preferably, the slits have arcuate ends to resist tearing. Cutouts 36 on opposite sides of the handle strap provide space for the fingers of a person lifting the carrier to grasp the underside of the handle strap. The handle strap also includes a central fold line 38, which is a continuation of the fold line 30.

Figure 2:
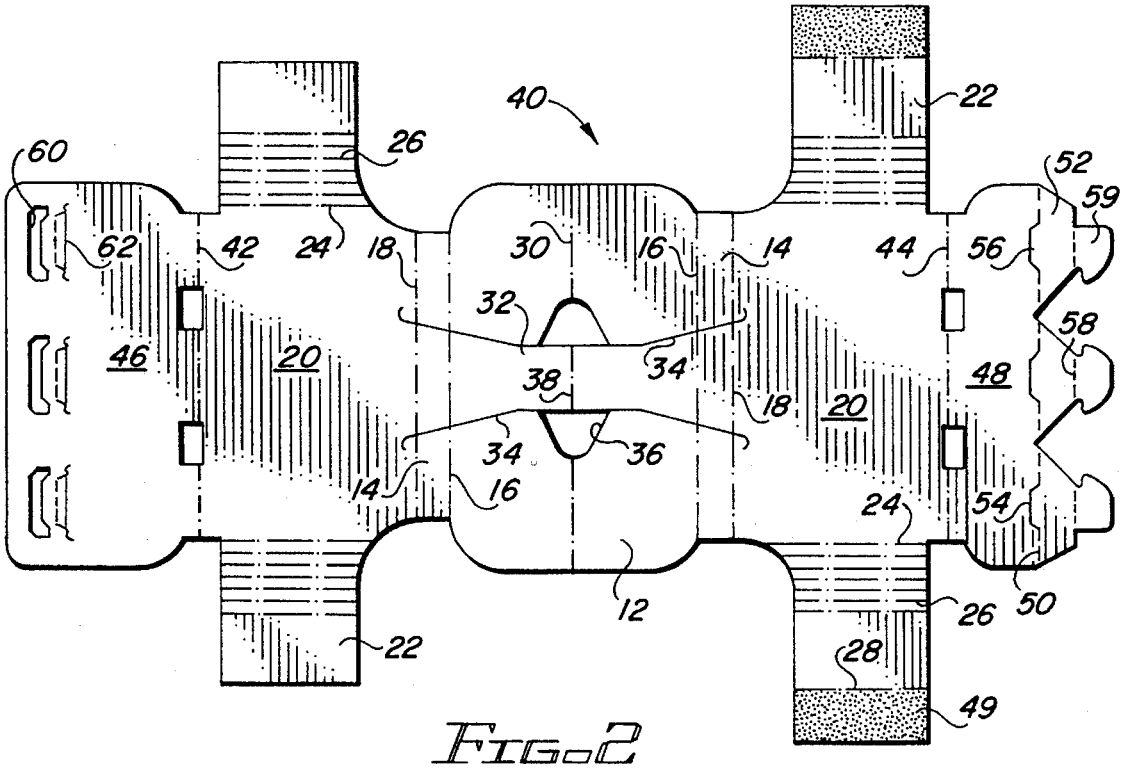
FIG. 2 is a plan view of a blank for forming the carrier of FIG. 1.

A blank 40 for forming the carrier of FIG. 1 is shown in FIG. 2. Top panel section 12 is centrally located and connected by the fold lines 16 to bevel panel sections 14, which are connected by fold lines 18 to side panel sections 20. The side panel sections are connected at their opposite ends by fold lines 42 and 44 to bottom panel flaps 46 and 48, respectively, and by the transverse score lines 24 to end panel sections 22. The end panel sections 22 at the right of the figure are also connected by fold lines 28 to glue flaps 49.

The bottom panel flap 48 includes fold line 50 to which secondary locking tabs 52 are connected. A slit 54 interrupts the fold line 50 at each locking tab to form primary locking tabs 56. In addition, each tab 52 includes a transverse fold line 58, creating an outer tab portion 59. The bottom panel flap 46 includes primary locking openings 60 and secondary locking slits 62 aligned with the locking tab 56 and the locking tab portion 59.

The slits 34 which form the handle strap 32 are parallel to each other in the central portion of the top panel section but diverge as they extend toward and through the bevel panel sections. This provides for wider portions at the side panels which assists in strengthening the handle strap against tearing. The fold line 38 can be seen to be a continuation of the fold line 30, separated by the finger hole cutouts 36, and to be centrally located so as to divide the top panel section into identical halves.

Figure 3:
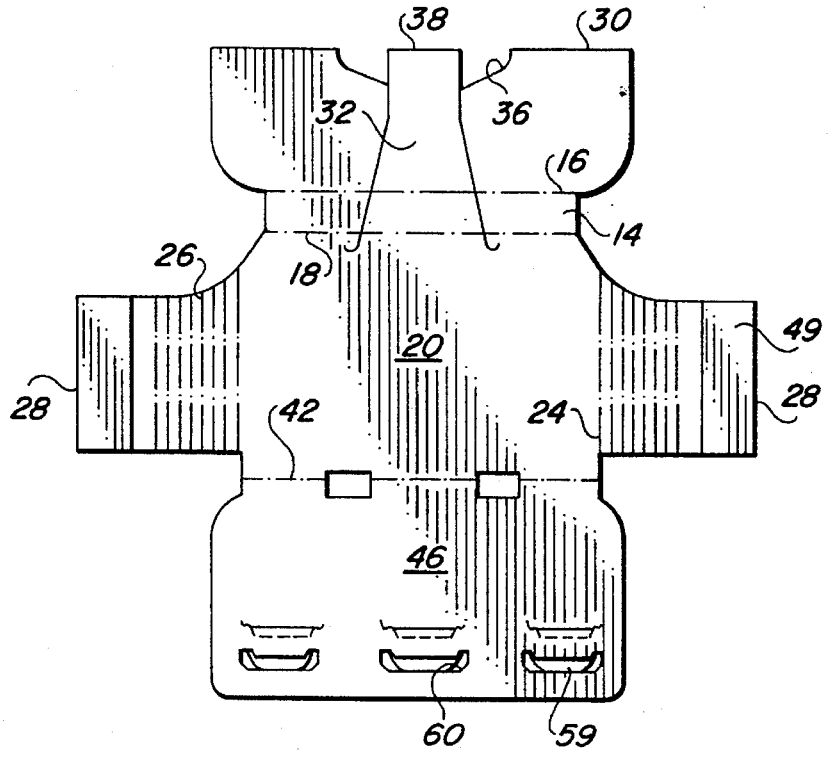
FIG. 3 is a plan view of a collapsed carrier formed from the blank of FIG. 2.

To form a collapsed carrier from the blank, glue is applied to the glue flaps 49, as shown in FIG. 2 by the stippling. The blank is then folded along the fold lines 30 and 38 so that the side panel and end panel sections at the left of the figure overlie the side panel and end panel sections at the right. The glue flaps 49 are then folded and adhered to the overlying end panel sections. The resulting collapsed carrier appears as illustrated in FIG. 3. It will be understood that the bottom panel flap 48 is hidden in this drawing figure by the bottom panel flap 46, although the tips of the end portions 59 of the locking tabs 52 can be seen through the locking openings 60 of the bottom panel flap 46.

Figure 4:
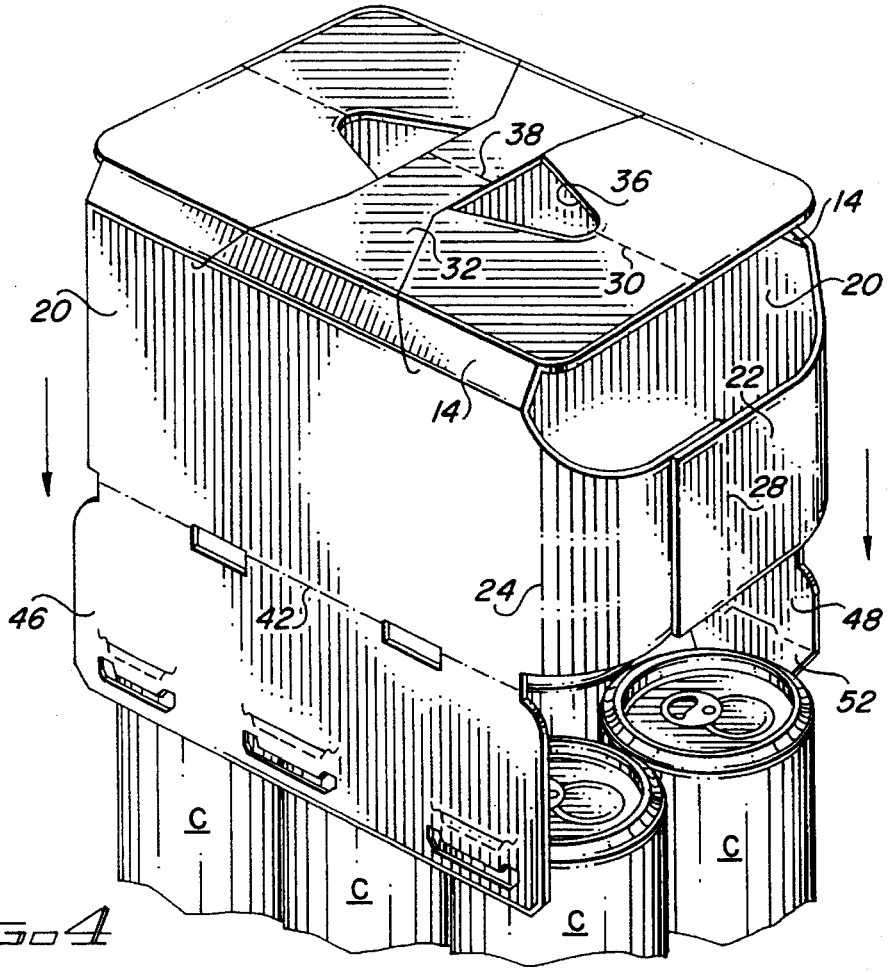
FIG. 4 is a pictorial view of an erected carrier in the process of being loaded with beverage cans.

To form the package of FIG. 1, the collapsed carrier of FIG. 3 is opened or erected by applying an inward force to the opposite folds 28. The opened carrier is then aligned with six beverage cans which have been grouped below it in the same relative arrangement they will be in when packaged, as illustrated in FIG. 4. The opened carrier is then lowered over the cans and the bottom panel flaps are folded in and connected to each other to form the bottom panel, resulting in the package of FIG. 1. In the design illustrated, the bottom panel flaps are connected by inserting the primary locking tabs 56 through the openings 60 and maintaining the primary locking tabs in locked position by inserting the outer tab portions 59 of the secondary locking tabs into the slits 62. It should be understood that the invention does not require that this particular bottom flap locking means, or any mechanical fastening means, be employed. As an alternative, bottom panel flaps could be glued together.

The carrier requires a minimal amount of paperboard or other suitable material for its formation and results in a number of benefits. Although the end panels will already have been formed by the time the opened carrier is lowered over the cans, it is nevertheless possible to tightly draw the carrier about the cans in the manner of a wrap-around carrier. In addition to providing for a tight fit, the design provides end panels which not only serve to further prevent the cans from falling out of the package but also to block the pricing code on the end cans so as not to be mistakenly scanned at a retail outlet. The series of score lines 26 permits the end panels to conform to the curvature of the cans at the corner areas of the package. The carrier handle can readily be actuated by inserting a finger in an opening 36 and raising the handle strap out of the plane of the top panel. The strap can then be gripped to lift the carrier.

The central fold lines 30 and 38 in the top panel are aligned with the fold lines 28 in the end panels, thereby allowing the carrier to be collapsed in the form shown in FIG. 3 for shipping. The presence of these fold lines does not interfere with or adversely affect the ability of the finished carrier to function as a compact, strong carton. The design does, however, provide end panels without the need for gusset panels or tuck flaps, which are normally required when providing a wrap-around carrier with partial end panels. This eliminates time consuming folding operations and costly apparatus for carrying them out.

Figure 5:
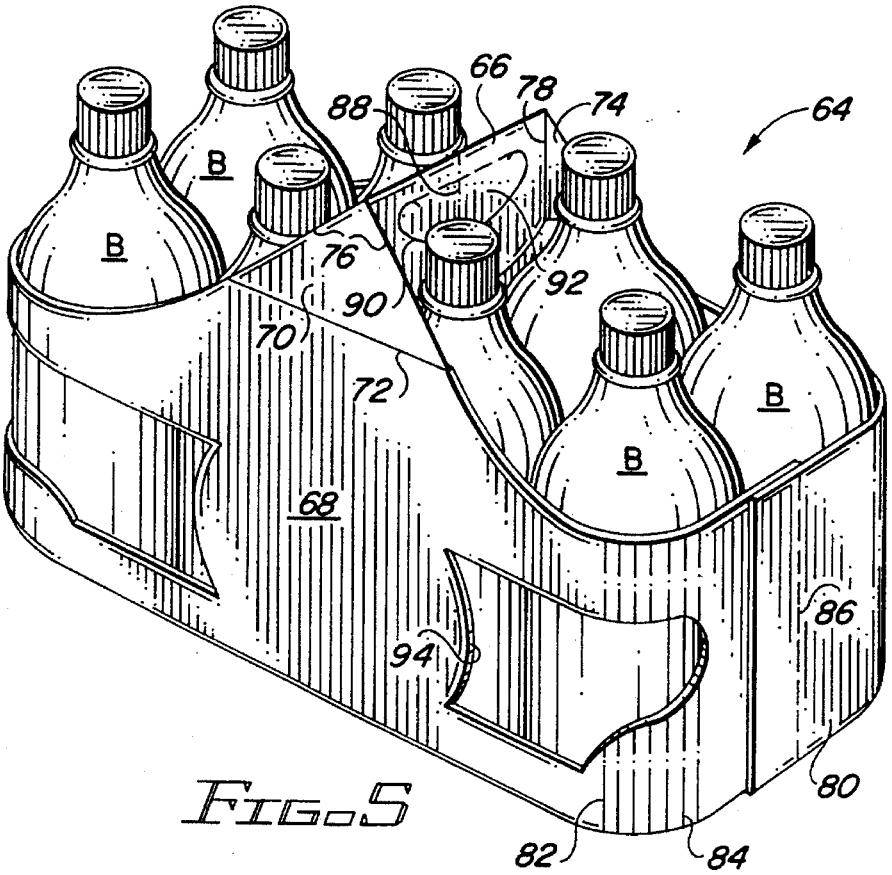
FIG. 5 is a pictorial view of a beverage bottle carrier representing another embodiment of the invention.

Another embodiment of the invention is shown in FIG. 5. The carrier 64 in this embodiment is an open-top basket-style design for holding beverage bottles B. In the illustrated design the carrier contains eight beverage bottles, four on either side of a central handle 66. The handle is a form of a so-called butterfly handle, connected at either end to side panels 68 by a triangular panel construction 70. The panels 70 are connected to the side panels 68 by horizontal score lines 72 and to tuck panels 74 by fold lines 76. The tuck panels are connected to the handle by fold lines 78. This arrangement is shown with more clarity in subsequent drawing figures discussed below.

As in the first embodiment, side panels 68 are connected to end panels 80 by score lines 82, and the end panels include a series of spaced parallel score lines 84. Fold lines 86 extend down the centerline of the end panels and are aligned with fold line 88 in the handle. The handle includes a hand grip opening 90 which is covered by a flap 92 connected to the handle. The fold line 88 also extends into the flap 92. Cutouts 94 in the side panels and the outer portions of the end panels are beneficial because they allow greater portions of the bottles to be on view, but they are not essential to the invention. Although the bottom panel of the carrier is not visible in this view, it is formed from bottom panel flaps in a similar manner to that of the first embodiment.

Figure 6:
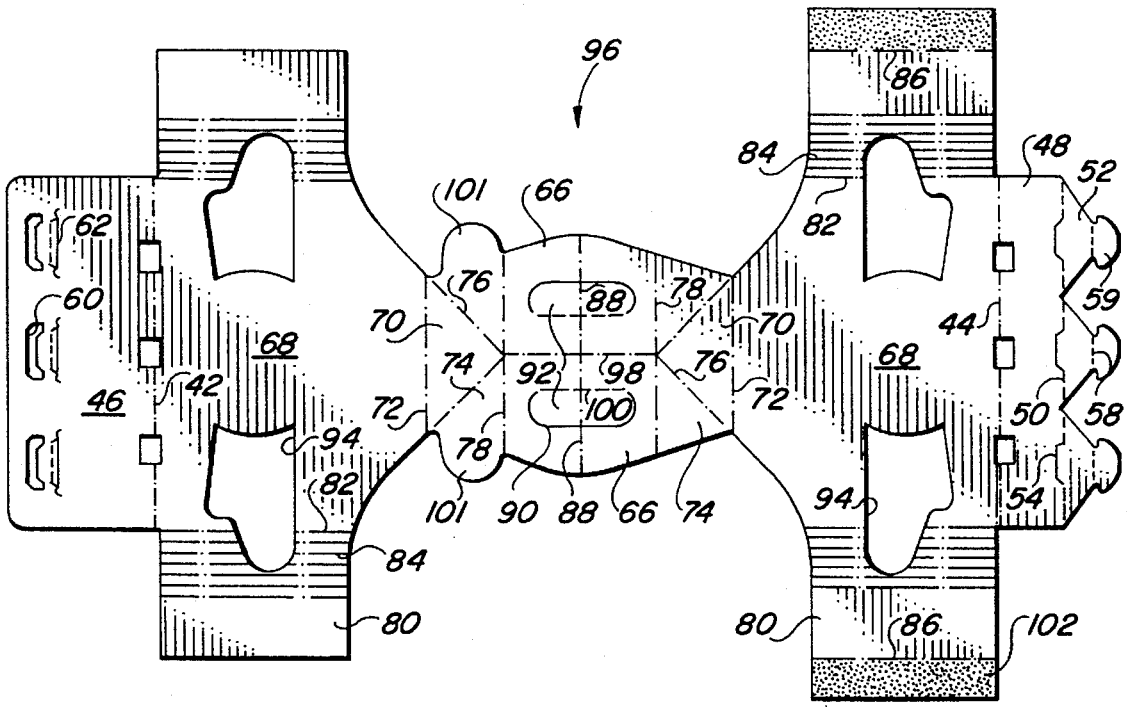
FIG. 6 is a plan view of a blank for forming the carrier of FIG. 5.

A blank for forming the carrier of FIG. 5 is indicated at 96 in FIG. 6. Similar handle panel sections 66 are connected to each other along fold line 98. Each section contains a handle opening 90 covered by the flap 92, which is connected to the handle panel section by fold line 100. The fold line 88 extends at right angles to the fold line 98 through the handle panel sections, including the handle opening flaps 92, bisecting the fold line 98. The tuck panels 74 are connected to the handle panel sections by fold lines 78 and to the triangular handle connecting panels 70 by fold lines 76. Preferably, one pair of tuck panels includes fingers or extensions 101 for a purpose explained below. The fold line 72 connecting the panels 70 to the side panel sections 68 are parallel to the fold lines 78 and 88. As in the first embodiment, the side panel sections are connected at their opposite ends to bottom panel flaps, which are similar in design to the bottom panel flaps in the first embodiment. Since the bottom panel flap arrangements are similar, the same reference numerals have been used to denote the bottom panel elements in the second embodiment as in the first embodiment. As in the first embodiment, the end panel sections 80 at the right of the figure are connected by fold lines 86 to glue flaps 102.

A collapsed carrier is formed from the blank in a similar manner as described in connection with the first embodiment. Glue is applied to the glue flaps 102, as shown in stipple in FIG. 6, and the blank is folded along the fold line 88 so that the side panel and end panel sections at the left of the figure overlie the side panel and end panel sections at the right. The glue flaps 102 are then folded and adhered to the overlying end panel sections. The resulting collapsed carrier appears as illustrated in FIG. 7, with the bottom panel flap 48 being hidden in this drawing figure by the bottom panel flap 46.

Figure 7:
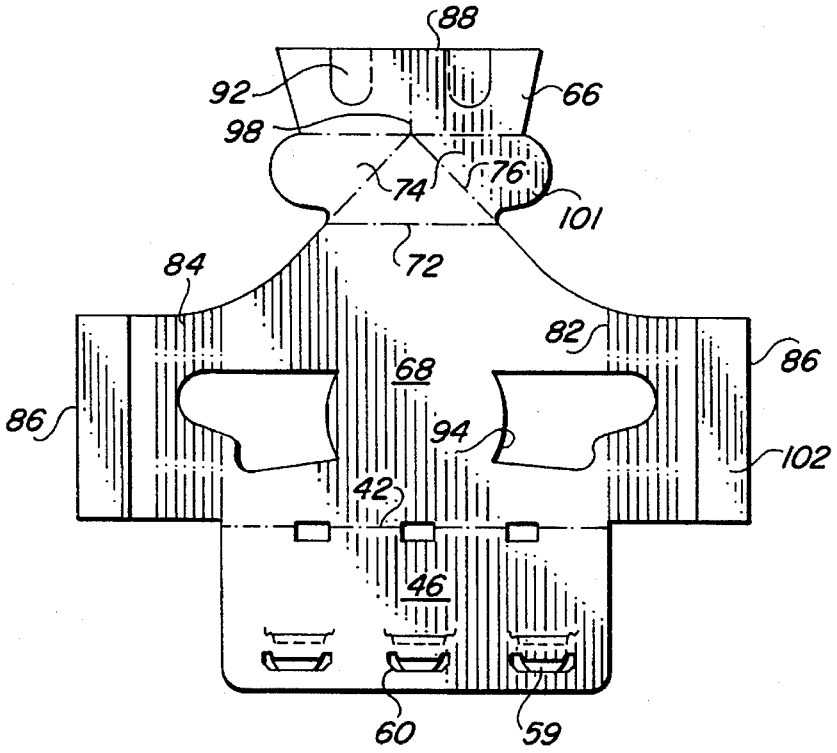
FIG. 7 is a plan view of a collapsed carrier formed from the blank of FIG. 6.
Figure 9:
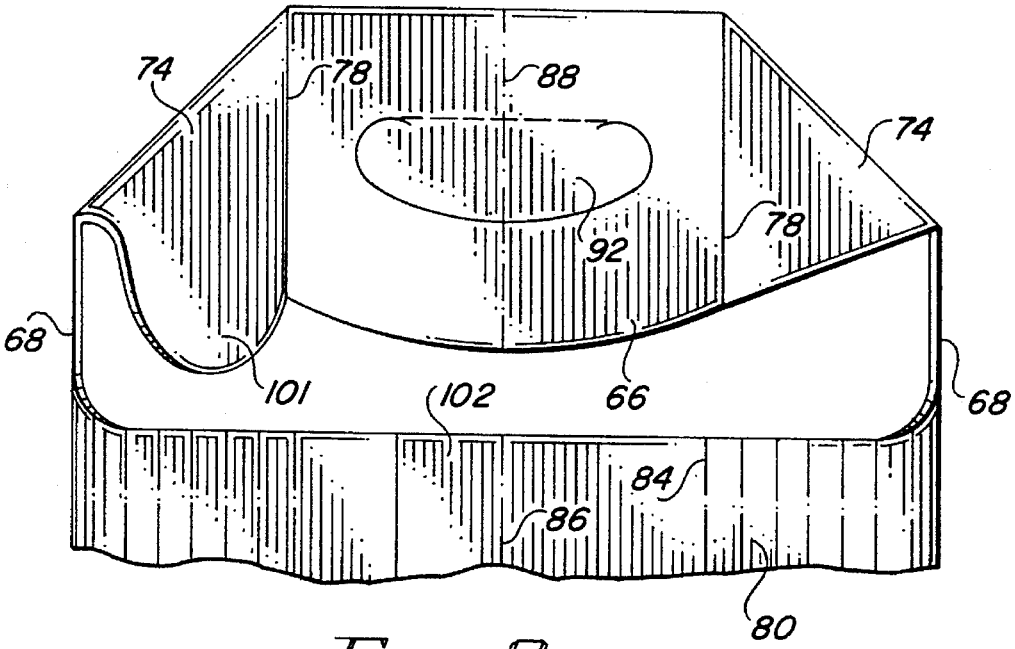
FIG. 9 is a partial end view of the carrier of FIG. 5, with the bottles removed for the purpose of more clearly illustrating the carrier handle.
Figure 8:
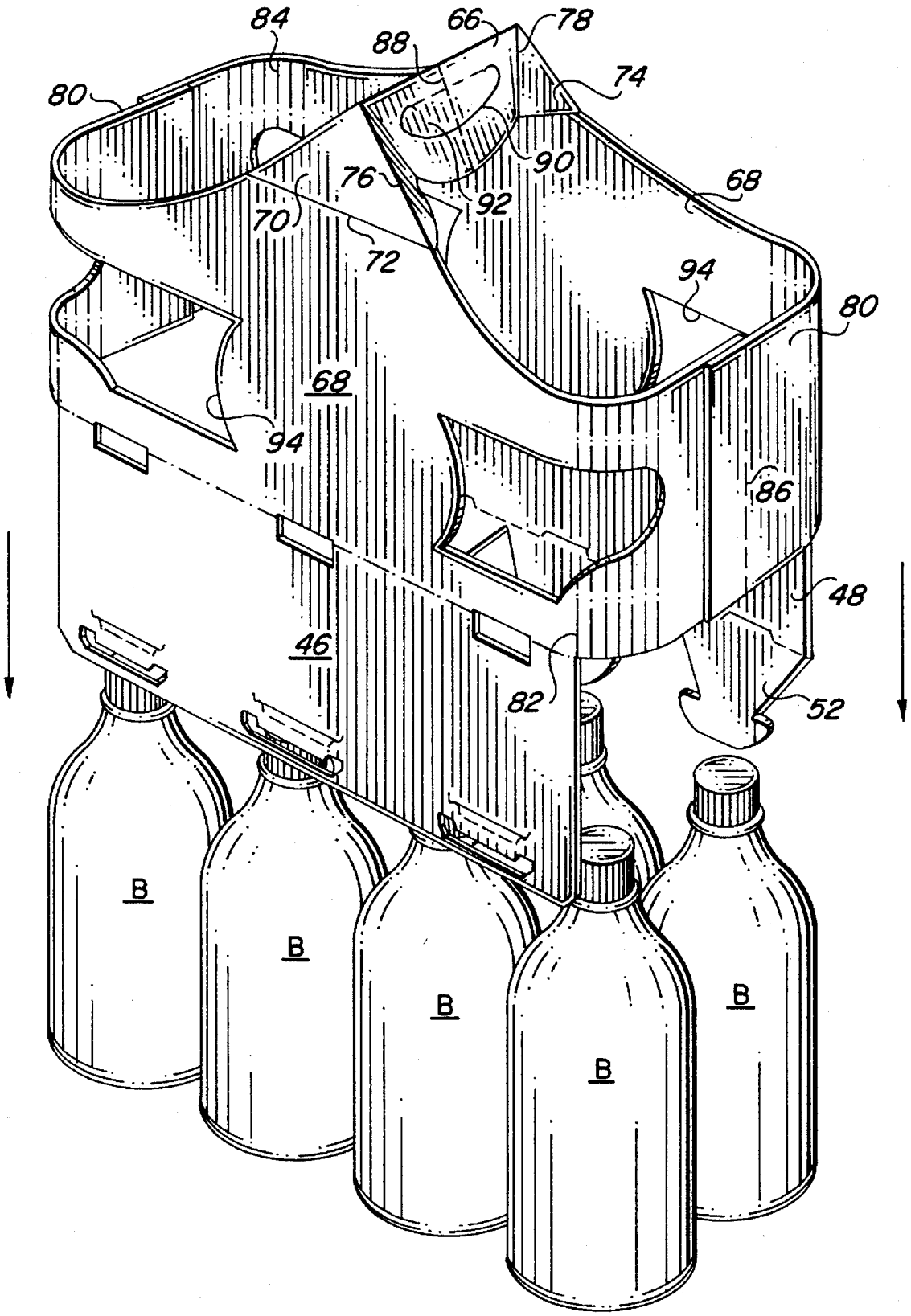
FIG. 8 is a pictorial view of an erected beverage bottle carrier in the process of being loaded.

To form the package of FIG. 5, the collapsed carrier of FIG. 7 is opened in the same manner as described in connection with the first embodiment and aligned with eight beverage bottles B to be packaged, as illustrated in FIG. 8. In addition, the handle panel sections 66 are folded toward each other about the central fold line 98. This is most conveniently accomplished by folding the tuck panels 74 about the fold lines 76 to pivot them toward the handle connecting panels 70, which pulls the handle panel sections toward each other to form the handle. Preferably, folding of the tuck panels is initiated by contacting the extensions 101 on one of the two pairs of tuck panels with moving elements of the packaging machine designed to carry out this function. Since the design of packaging machine elements and the means to move them at coordinated times with respect to the carriers is well within the skill of packaging machine designers, it is not necessary to describe the details of such machinery. After the handle has been formed, the opened carrier is then lowered over the bottles and the bottom panel flaps are folded in and connected to each other to form the bottom panel. The handle panel sections need not be glued to each other since the shape of the formed carrier and the abutting bottles prevent the handle sections from springing apart. The finished handle panel is best seen in FIG. 9, which illustrates an end view of the carrier with the bottles removed. The central fold lines 88 and 86 can be seen to lie in the same vertical plane, and the tuck panels are in their fully folded condition.

The carrier of the second embodiment combines the benefits of a basket-style carrier with the benefits of a wrap-around carrier in that the carrier can be tightly drawn about the cans. As in the carrier of the first embodiment, the series of score lines in the end panels permits the end panels to conform to the curvature of the cans at the corner areas of the package. The carrier is simple in design, avoiding the need to provide riser panels or a handle panel of full height as a structural connection to the end panels. Use of the handle is simple, accomplished by inserting the fingers through the handle openings from either side of the handle panel. This pivots the handle flaps 92 up through the opposite side of the handle panel, which affords a cushion for the fingers.

As in the first embodiment, the central fold lines 88 in the handle panel are aligned with the fold lines 86 in the end panels, thereby allowing the carrier to be collapsed in the form shown in FIG. 7 for shipping. Also as in the first embodiment, the presence of these fold lines does not interfere with or adversely affect the ability of the carrier to function as a compact, strong carton.

Although the invention has been described with respect to carriers for packaging beverage cans and bottles, it will be understood that carriers formed in accordance with the invention may be used to hold other types of articles as well.

Although specific carrier designs have been disclosed, it will be understood that changes to certain features and aspects of the design which do not affect the overall basic function and concept of the invention may be made by those skilled in the art without departing from the spirit and scope of the invention, as defined by the appended claims.

What is claimed is:

1. An article carrier, comprising:

a pair of spaced substantially parallel side panels;

a pair of spaced end panels connected to the side panels;

a bottom panel connected to the side panels; and a handle connected to and extending between the side panels;

the handle and each of the end panels including a fold line lying in a common plane which is substantially parallel to and spaced an equidistant amount from the side panels, whereby the carrier can be formed from a collapsed state in which the handle and the end panels are folded about said fold lines.

2. An article carrier as defined in claim 1, wherein the bottom panel is comprised of connected bottom panel flaps, each flap being connected to one of the side panels.

3. An article carrier as defined in claim 1, including a top panel connected to the side panels on either side of the handle, the top panel being substantially parallel to the bottom panel and including a fold line lying in the same plane as the fold lines of the handle and the end panels.

4. An article carrier as defined in claim 3 wherein the handle is a strap defined by spaced slits in the top panel.

5. An article carrier as defined in claim 1, wherein the carrier includes open top portions between the handle and the end panels.

6. An article carrier as defined in claim 5, wherein the handle is comprised of two opposite handle panels connected by a fold line extending transversely of the side panels, each handle panel being foldably connected to a tuck panel and each tuck panel being foldably connected to a handle support panel, each handle support panel being connected by a fold line to an associated side panel, each handle panel including a fold line lying in a plane substantially parallel to the side panels.

7. An article carrier as defined in claim 6, wherein the handle panels include aligned handle openings.

8. An article carrier as defined in claim 7, wherein each handle panel includes a flap covering the handle opening therein, each flap including a fold line which is a continuation of the fold line in the associated handle panel.

9. A article carrier as defined in claim 1, wherein the end panels includes a plurality of score lines substantially parallel to the score lines connecting the side panels to the end panels, the plurality of score lines permitting the end panels to closely conform to the shape of curved articles at the ends of the carrier.

10. A collapsed article carrier, comprising:

a pair of side panels in overlying face-to-face relationship, each side panel having an upper edge and a lower edge;

a pair of end panels, each end panel being connected to adjacent ends of the side panels and being divided into substantially equal halves by a fold line, the end panels being folded about said fold line so that each end panel half overlies and is in face-to-face relationship with the other associated end panel half;

a bottom panel flap connected to the lower edge of at least one of the side panels;

a handle having opposite ends, each end being connected to the upper edge of one of the side panels;

the handle being divided into substantially equal halves by a fold line extending at substantially right angles to the fold lines of the end panels, the handle being folded about said handle fold line so that each half of the handle overlies and is in face-to-face relationship with the other handle half; and means for allowing the handle to be readily gripped when a carrier formed from the collapsed carrier is lifted by the handle.

11. A collapsed article carrier as defined in claim 10, wherein the handle is a strap defined by spaced slits in the top panel.

12. A collapsed article carrier as defined in claim 10, wherein the handle is comprised of two opposite handle panels connected by a fold line extending parallel to the end panel fold lines, each handle panel being foldably connected to a tuck panel and each tuck panel being foldably connected to a handle support panel, wherein each tuck panel connected to one of the handle support panels includes an extension, whereby pressure exerted on the extensions of a carrier erected from the collapsed article carrier causes the handle panels to be folded toward each other.

13. A blank for forming an article carrier, comprising:

a centrally located handle having opposite end portions;

a side panel section connected by fold line to each handle end portion;

a bottom panel flap connected to at least one of the side panel sections by a fold line extending substantially parallel to the fold line connecting the side panel to the handle;

an end panel flap connected to opposite ends of each side panel section;

the handle being divided into substantially equal halves by a fold line extending substantially parallel to the fold lines connecting the handle to the side panel sections;

a glue flap connected by a fold line to two of the end panel flaps, the glue flap fold lines extending at substantially right angles to the handle fold line, each glue flap being on opposite sides of the handle; and means for allowing the handle of a carrier formed from the blank to be readily gripped when the carrier is lifted by the handle.

14. A blank as defined in claim 13, wherein the handle is a strap defined by spaced slits in the top panel section.

* * * * *